US006659821B2

(12) United States Patent
Nakajima

(10) Patent No.: US 6,659,821 B2
(45) Date of Patent: Dec. 9, 2003

(54) EXHAUST STRUCTURE FOR JET PROPULSION BOAT

(75) Inventor: Jun Nakajima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/216,924

(22) Filed: Aug. 13, 2002

(65) Prior Publication Data

US 2003/0064644 A1 Apr. 3, 2003

(30) Foreign Application Priority Data

Aug. 20, 2001 (JP) ..... 2001-249277

(51) Int. Cl.[7] ..... B63H 21/10
(52) U.S. Cl. ..... 440/89 R; 440/89 J
(58) Field of Search ..... 440/89 R, 89 F, 440/89 J, 89 E

(56) References Cited

U.S. PATENT DOCUMENTS 6,506,086 B2 * 1/2003 Matsumoto ..... 440/89 R

FOREIGN PATENT DOCUMENTS

JP 200-282840 A 10/2000

* cited by examiner

*Primary Examiner*—Jesus D. Sotelo
(74) *Attorney, Agent, or Firm*—Birch, Stewart, Kolasch & Birch, LLP

(57) ABSTRACT

An exhaust structure for a jet propulsion engine in which exhaust noise can be reduced. The exhaust structure includes a tunnel-shaped pump chamber provided at a the rear portion of a hull, a jet pump provided in a pump chamber, a driving engine connected to the jet ump, and an exhaust port of the exhaust pipe extending from the engine disposed facing toward the pump chamber. A sound-deadening resonator is disposed inside the pump chamber, and the exhaust pipe is brought into communication with the resonator.

20 Claims, 9 Drawing Sheets

EXHAUST STRUCTURE FOR JET PROPULSION BOAT

CROSS-REFERENCE TO RELATED APPLICATION

The present application claims priority under 35 U.S.C. §119 to Japanese Patent Application No. 2001-249277, filed Aug. 20, 2001, the entire contents of are which hereby incorporated by reference.

BACKGROUND OF THE INVENTION

1. Field of the Invention

The present invention relates to an exhaust structure for a jet propulsion boat in which exhaust gas from the engine is discharged into the pump chamber by providing a jet propulsion machine inside a pump chamber of the hull and connecting an exhaust pipe to the pump chamber.

2. Description of Background Art

The jet propulsion boat is a vessel provided with a jet pump mounted at the rear portion of the hull, and propelled by drawing in water from the vessel bottom by driving the jet pump by the engine, and forcing the water rearwardly.

An exhaust structure for a jet propulsion boat has been disclosed in Japanese Patent Laid-Open No. 282840/2000 entitled "exhaust structure for a jet propulsion boat". The means to lower the exhaust noise generated in the jet propulsion boat is disclosed in the same publication. According to this technology, a resonator for sound-deadening is provided on the exhaust pipe connected to the engine. Exhaust noise is resonated by means of the resonator, so that the exhaust noise is reduced.

In the above disclosure, a part of the exhaust pipe is formed into a substantially U-shape which is upwardly convex in order to prevent water from entering from the outlet port of the exhaust pipe into the engine side. Forming a part of the exhaust pipe into a substantially U-shape makes the length of the exhaust pipe relatively long. Thus, in order to attenuate the noise in the elongated exhaust pipe, the length of the resonator must be long relative to the exhaust pipe.

Therefore, in order to mount the elongated resonator inside the hull, a sufficient storage space must be secured.

However, the space in the hull is limited. Thus, the layout of the required accessories of the boat which are also to be mounted inside the hull must be considered, in order to secure the relatively large storage space required for the resonator in this limited space. In other words, securing a storage space for and mounting the resonator, which is required for reducing the exhaust noise of the jet propulsion boat, has proved to be difficult.

Accordingly, it is an object of the present invention to provide an improved exhaust structure for a jet propulsion boat that addresses the above problem.

SUMMARY AND OBJECTS OF THE INVENTION

In order to solve the problem, the present invention provides an exhaust structure for a jet propulsion boat in which a tunnel-shaped pump chamber is provided at the rear portion of the hull, a jet propulsion machine is provided in the pump chamber, an engine is connected to the jet propulsion machine for driving the boat, and an exhaust port of the exhaust pipe extending from the engine is faced toward the pump chamber. Further, a resonator for sound-deadening is disposed in the pump chamber, and the exhaust pipe is brought into communication with the resonator.

In this case, since the jet propulsion machine is disposed at the center of the tunnel-shaped pump chamber, a space is left in the vicinity of the wall surfaces of the top wall and the left and right walls of the pump chamber as a dead space.

Therefore, the resonator for sound-deadening can be mounted effectively in the dead space in the pump chamber. Therefore, the difficulty of securing a storage space in the boat for the resonator is eliminated.

The invention also includes an exhaust port disposed in the resonator by passing the exhaust pipe through the peripheral wall of the resonator, and an opening provided on the bottom wall of the resonator at the location facing upwardly toward the exhaust pipe, and downwardly toward pump chamber.

The exhaust port is disposed in the resonator and an opening is formed on the bottom wall of the resonator at the location facing toward the pump chamber. Therefore, exhaust gas discharged from the exhaust port and cooling water discharged together with exhaust gas can be conducted effectively out through the opening on the bottom of the resonator.

The opening is divided into a first and a second opening by a supporting beam, and a valve body is attached on the supporting beam so that the first and the second openings can be opened and closed by a pair of flaps provided on the valve body.

The first and the second openings in the resonator can be open and closed individually by the flaps. By providing separate individual flaps, the size of the flaps may be reduced, which allows the first and the second openings to be quickly closed by the respective flaps. Quick closing of the first and the second openings by the flaps helps to prevent water from entering the openings.

Further, the supporting beam of the present invention is provided with a guide portion of V-shaped or substantially V-shaped cross section projecting toward the exhaust port.

Since the supporting beam is provided with a guide portion of V-shaped or substantially V-shaped cross section projecting toward the exhaust port, exhaust gas and cooling water discharged together with exhaust gas can be guided via the guide portion and conducted smoothly to the first and second openings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
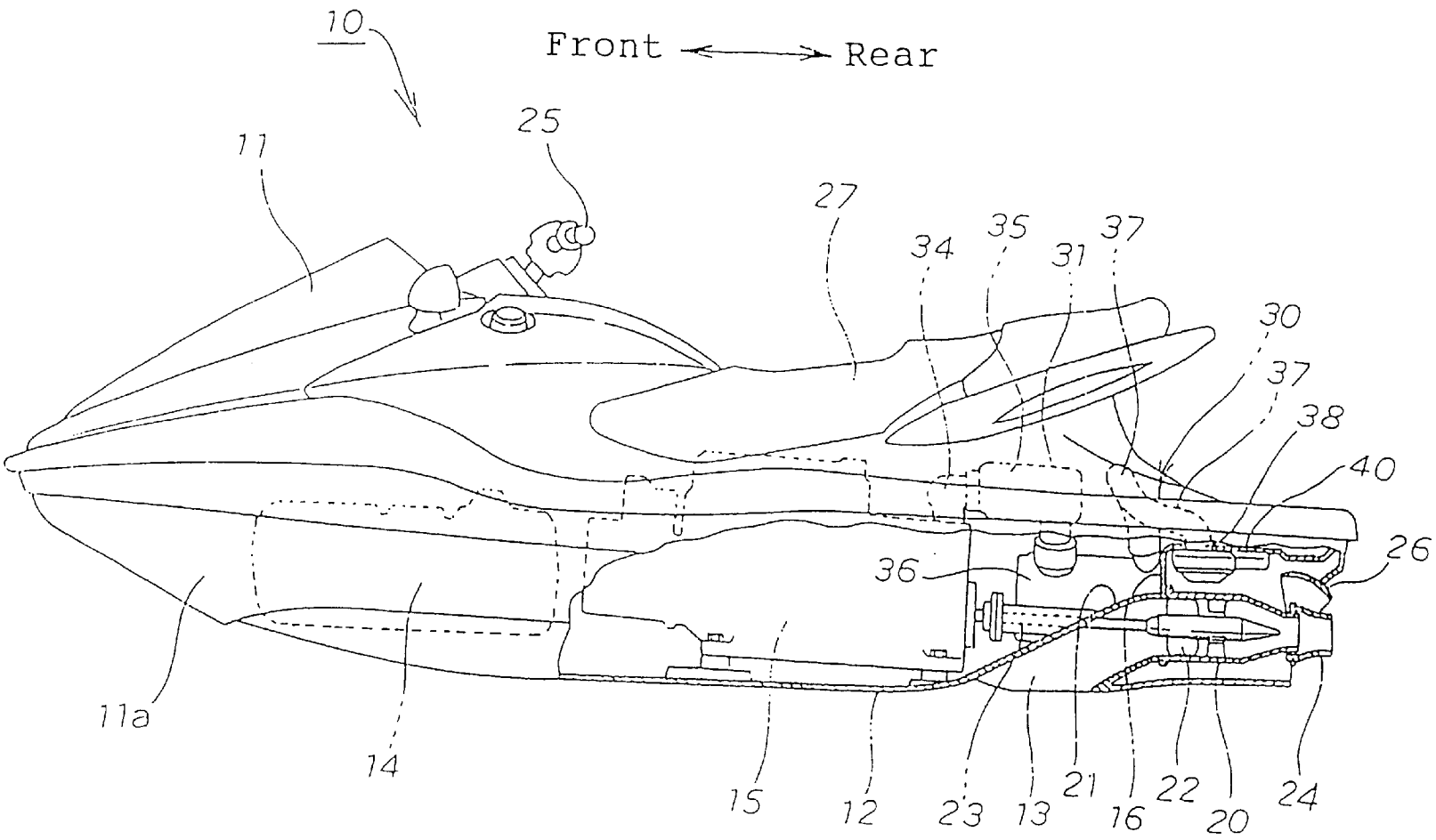
FIG. 1 is a side view of the jet propulsion boat provided with an exhaust structure according to the present invention (first embodiment)

FIG. 1 is a side view of a jet propulsion boat provided with an exhaust structure (first embodiment) according to the present invention.

The jet propulsion boat 10 includes a fuel tank 14 mounted at the front portion 11*a* of the hull 11, an engine 15 provided rearwardly of the fuel tank 14, a pump chamber 16 provided rearwardly of the engine 15, and a Jet pump (jet propulsion machine) 20 provided in the pump chamber 16. Also included are an exhaust structure 30 for a jet propulsion boat attached to the engine 15 on the air intake side and to the pump chamber 16 on the exhaust side, a steering handle 25 mounted above the fuel tank 14, and a seat 27 mounted rearwardly of the steering handle 25.

The jet pump 20 includes a housing 21 extending rearward from the opening 13 of the vessel bottom 12, and an impeller 22 rotatably mounted in the housing 21 and connected to the drive shaft 23 of the engine 15.

With the jet pump 20, water drawn in through the opening 13 of the vessel bottom 12 can be forced from the steering pipe (steering nozzle) 24 disposed at the rear of the hull 11 by driving the engine 15 and rotating the impeller 22 via the rear end opening of the housing 21. The water forced from the steering nozzle 24 can be guided toward the front by moving the reverse bucket 26 to the position rearwardly of the steering nozzle 24.

The vessel 10 can be propelled by supplying fuel from the fuel tank 14 to the engine 15 to drive the engine 15, transmitting a driving force of the engine 15 to the impeller 22 via the drive shaft 23, drawing in water through the opening 13 of the vessel bottom 12 by rotating the impeller 22, and forcing the water drawn in through the rear end of the housing 21 from the steering nozzle 24.

Figure 2:
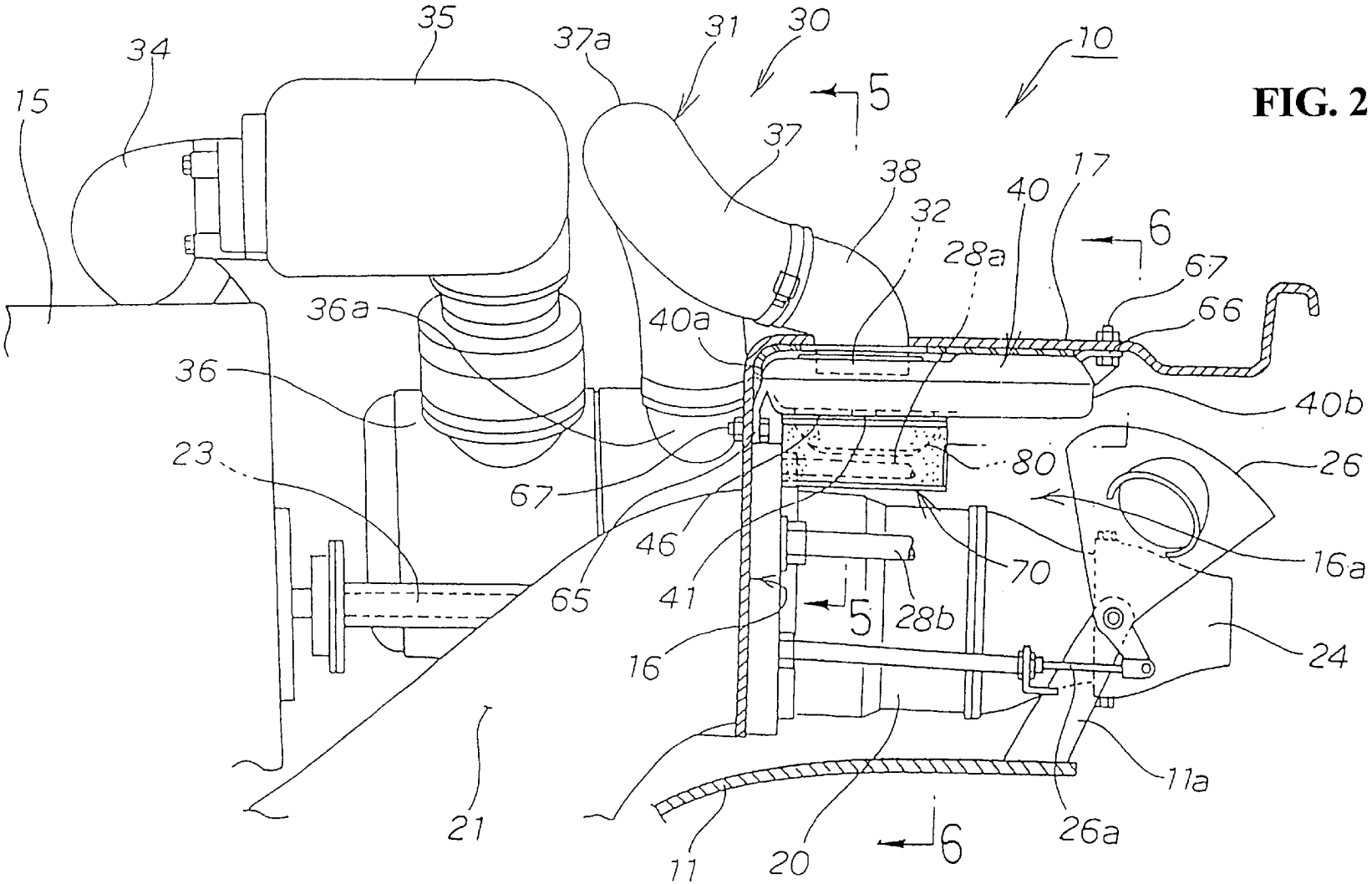
FIG. 2 is a side view of the exhaust structure for a jet propulsion boat according to the present invention (first embodiment)

FIG. 2 is a side view of the exhaust structure for a jet propulsion boat according to the present invention (first embodiment).

The exhaust structure 30 for a jet propulsion boat is such that an exhaust pipe, 31 is connected to an exhaust manifold (not shown) of the engine 15, and the end 32 of the exhaust pipe 31 is passed through the top wall 17 of the pump chamber 16, the end 32 of the exhaust pipe 31 in turn passes through the resonator 40 disposed on the top wall 17. The opening 46 of the bottom wall 41 of the resonator 40 (See FIG. 4) faces toward the internal space 16*a* of the pump chamber 16.

The exhaust pipe 31 includes an exhaust pipe 34 connected to the exhaust manifold, an exhaust body 35 connected to the exit of the exhaust pipe 34, a muffler 36 connected to the exit side of the exhaust body 35, a connecting pipe 37 connected to the exit 36*a* of the muffler 36, and a tail pipe 38 connected to the exhaust port of the connecting pipe 37. The end 32 of the tail pipe 38 (cf. the end of the exhaust pipe 31) is attached to the top wall 17 of the pump chamber 16.

The connecting pipe 37 is a pipe bent so that the convex portion 37*a* comes to the top. By disposing the convex portion 37*a* of the connecting pipe 37 on top, in the unlikely event that water enters from the tail pipe 38 to the connecting pipe 37, the entered water cannot flow over the convex portion 37*a* of the connecting pipe 37, thereby preventing water from entering into the engine 15 side. That is, the connecting pipe 37 has a "water locking" capability.

The pump chamber 16, being formed into the shape of a tunnel, the internal space 16*a* of which extends in the fore-and-aft direction, includes a jet pump 20 at the center, and a reverse bucket 26 provided in the vertical direction on the rear end opening side via a bracket 11*a*. A steering pipe (steering nozzle) 24 is provided at the rear end of the housing 21 of the jet pump 20, the steering pipe 24 being capable of swinging in the lateral direction.

The steering direction of the hull 11 can be controlled by operating the steering cable by the steering handle shown in FIG. 1 and swinging in the lateral direction. The hull 11 can be reversed by operating the reverse cable 28*a* by the lever of the steering handle 25 to dispose the reverse bucket 26 rearwardly of the steering nozzle 24.

Figure 3:
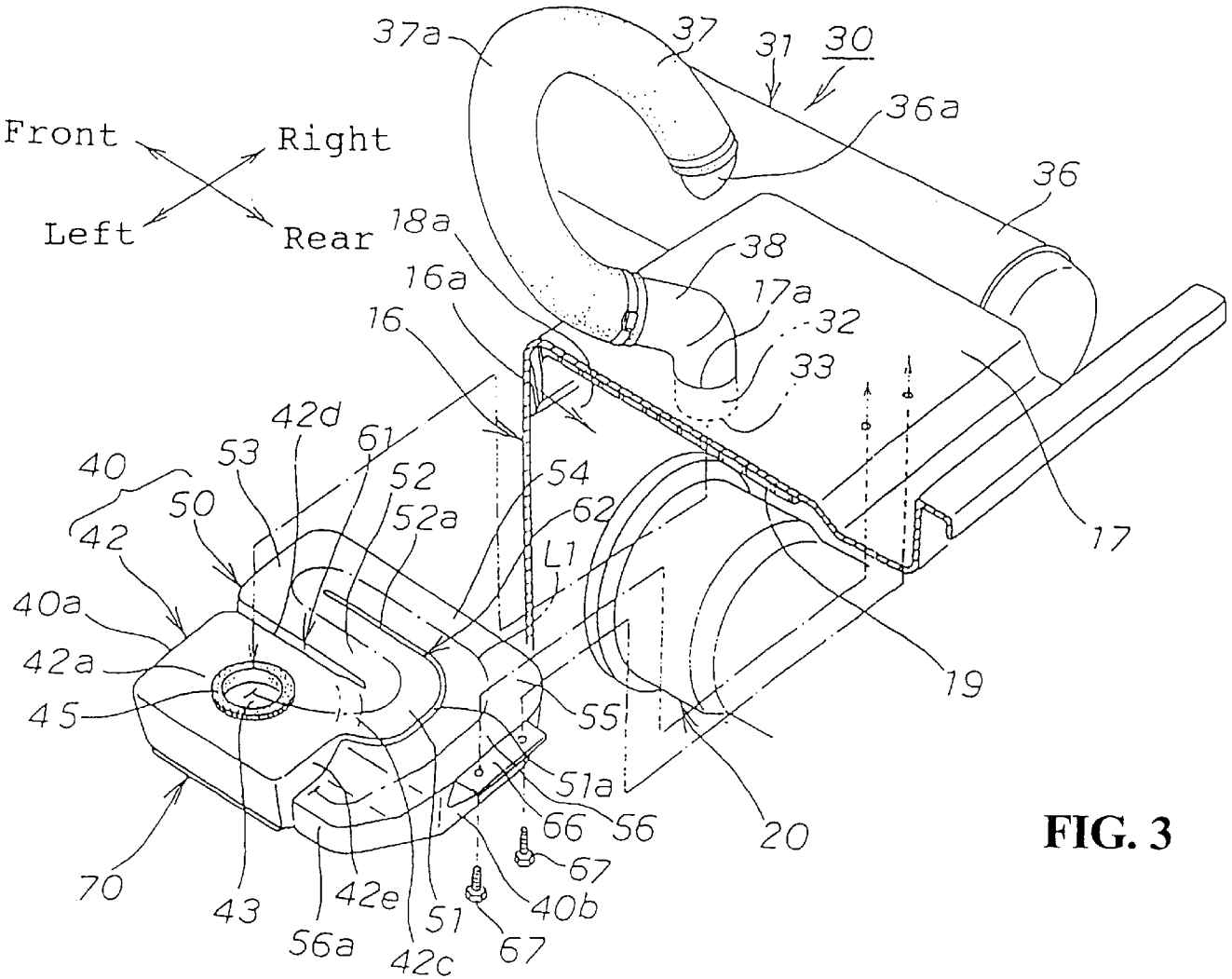
FIG. 3 is an exploded perspective view of the exhaust structure for a jet propulsion vessel according to the present invention (first embodiment)

FIG. 3 is an exploded perspective view of the exhaust structure for a jet propulsion vessel according to the present invention (first embodiment).

The resonator 40 is a member bent in the meandering shape, and each bent portion is placed adjacent with each other so that the entire resonator 40 forms a substantially flat plate.

The resonator 40 includes a base 42 to be mounted at the end 32 of the tail pipe 38 and a resonator body 50 integrally formed with the base 42.

The base 42 is a substantially rectangular frame body provided with a hollow portion 43 therein, including a mounting port 44 (shown in FIG. 5) formed on the upper wall 42*a* of the frame body (that is, on the peripheral wall of the resonator), and a packing 45 attached on the mounting port 44. The end 32 of the tail pipe 38 can be inserted into the packing 45 so that the exhaust port 33 of the tail pipe 38 (that is, the exhaust port of the exhaust pipe 31) faces toward the hollow portion 43 of the base 42.

The resonator body 50 is a hollow pipe of rectangular in cross section extending in the meandering shape from the right rear corner 42*c* of the base 42, which is brought into communication with the hollow portion 43 of the base 42.

The resonator body 50 includes a first bent portion 51 bent from the right rear corner 42*c* of the base 42 counterclockwise by about 180°, a first extended portion 52 extending forward from the tip of the first bent portion 51 along the right side 42*d* of the base 42, a second bent portion 53 bent from the tip of the first extended portion 52 clockwise by about 180°, and a second extended portion 54 extending rearward from the tip of the second bent portion 53 along the right side 52*a* of the first extended portion 52. Also included are a third bent portion 55 bent from the tip of the second extended portion 54 clockwise by about 90°, and a third extended portion 56 extending from the tip of the third bent portion 55 along the rear side 51*a* of the first bent portion 51 and the rear side 42*e* of the base 42.

The tip 56*a* of the third extended portion 56, that is, the tip of the resonator body 50 is formed in the closed state.

By bending the resonator body 50 in the meandering state as described above, the length L1 of the resonator 40 can be secured to a desired length while keeping the size of the resonator 40 to a minimum. Since the resonator 40 can be formed to have a desired length, the sound-deadening effect of the exhaust noise in from the long exhaust pipe can be sufficiently attenuated.

In addition, a first gap 61 and a second gap 62 are formed by bending the resonator 40 in the curved state. Therefore, by providing a first rib 63 (shown in FIG. 5) and a second rib 64 (shown in FIG. 5) respectively at the first gap 61 and the second gap 62, the two wall surfaces constituting the first gap 61 are integrally connected, and likewise, the two wall surfaces constituting the second gap 62 are integrally connected.

Accordingly, the resonator 40 is formed generally into a substantially rectangular shape (flat plate shape). By forming the resonator 40 into the plate shape, the size of resonator 40 may be reduced to a minimum. Thus, the resonator 40 can be disposed in a relatively small storage space.

With the resonator 40 bent in the meandering shape, by bringing the hollow portion 50*a* (shown in FIG. 5) of the resonator body 50 into communication with the hollow portion 43 of the base 42, the resonator body 50 can be brought into communication with the connecting pipe 37 through the tail pipe 38. Accordingly, resonance from the connecting pipe 37 can be attenuated, thereby reducing the exhaust noise.

The plate shaped resonator 40 thus constructed includes a front mounting bracket 65 (shown in FIG. 2) on the front wall 40*a* thereof, and a rear mounting bracket 66 on the rear wall 40*b* thereof.

The resonator 40 can be mounted on the top wall 17 in the pump chamber 16 by attaching the front mounting bracket 65 on the front wall 18*a* of the pump chamber 16 with bolts 67, 67, and attaching the rear mounting bracket 66 on the top wall 17 of the pump chamber 16 with bolts 67, 67.

With most jet propulsion boats, due to mounting various accessories in the hull that is required for a vessel, there is very little extra space left in the hull. However, it is likely that there is a space left in the vicinity of the top wall 17 (wall surface) of the pump chamber 16.

Therefore, as shown in FIG. 2, in order to make effective use the dead-space left near the top wall 17 of the pump chamber 16, the resonator 40 is mounted onto the top wall 17.

Furthermore, since the pump chamber 16 is located outside the hull 11, by placing the resonator 40 along the top wall 17 of the pump chamber 16, the resonator 40 can be mounted outside the hull 11. By mounting the resonator 40 outside the hull 11, it is not necessary to provide a storage space for storing the resonator 40 inside the hull 11.

In this manner, by placing the resonator 40 along the top wall 17 in the pump chamber 16, resonator 40 can easily be mounted.

In addition, by mounting the resonator 40 on the top wall 17 in the pump chamber 16, the tail pipe 38 can be mounted on the top wall 17 in the pump chamber 16. Therefore, the length of the connecting pipe 37 which communicates with the tail pipe 38 can be reduced as much as possible. Thus, the space for providing the tail pipe 38 can be secured in the hull 11 relatively easily.

Figure 4:
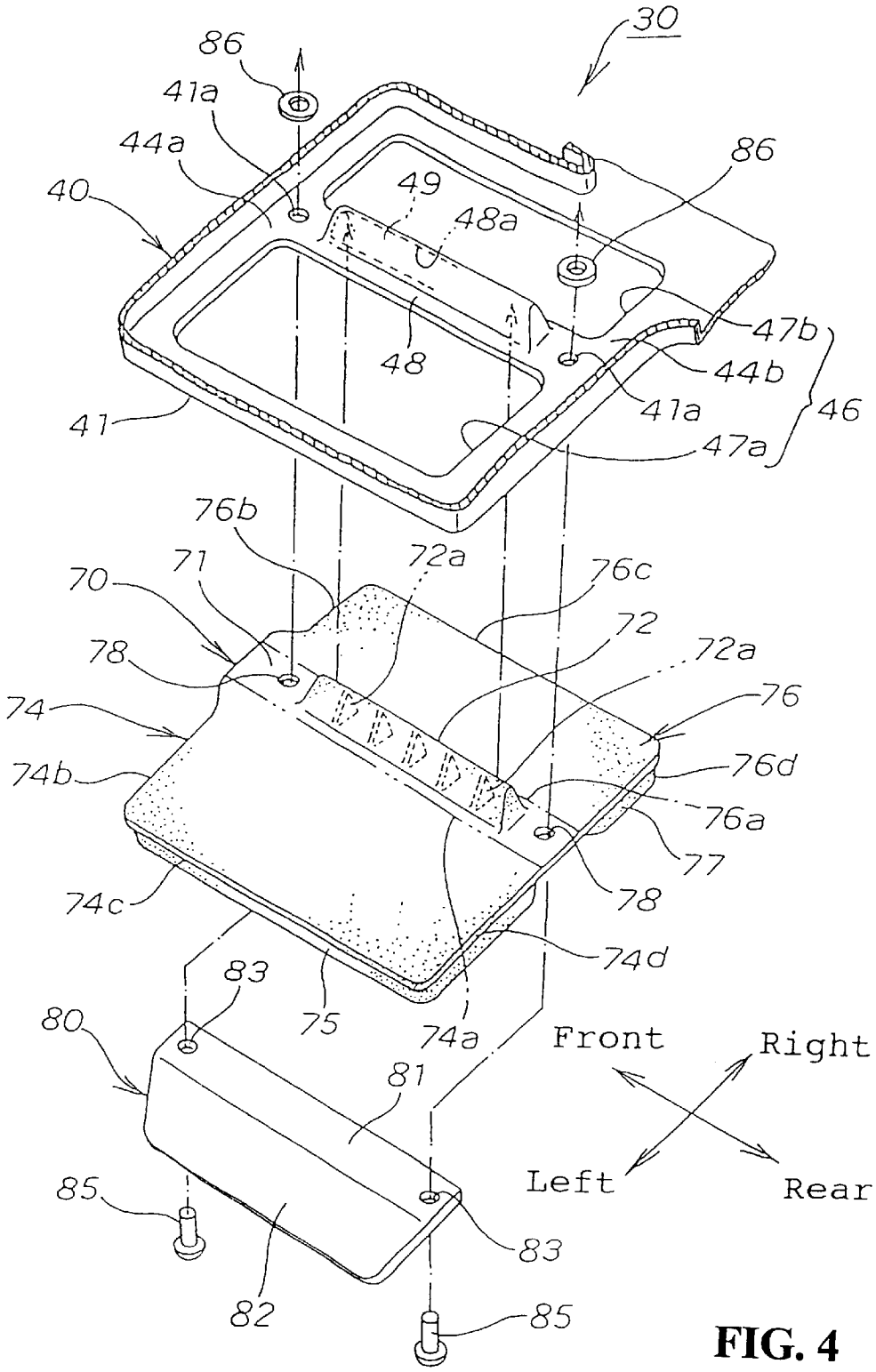
FIG. 4 is an exploded perspective view showing a principal portion of the exhaust structure for a jet propulsion boat according to the present invention (first embodiment)

FIG. 4 is an exploded perspective view showing a principal portion of the exhaust structure of the jet propulsion boat according to the present invention (first embodiment).

The exhaust structure 30 of the jet propulsion boat includes an opening 46 on the bottom wall 41 of the resonator 40, and a valve body 70 mounted at the opening 46 via a supporting bracket 80. The opening 46, the valve body 70, and the supporting bracket 80 will be described below.

The opening 46, of the resonator 40 is an exhaust hole formed into the substantially rectangular shape, and is divided into the first opening 47*a* and the second opening 47*b* by laying a supporting beam 48 between the opposing front and rear sides 44*a*, 44*b* of the opening 46.

The supporting beam 48 includes a guide portion 49 of V-shaped or substantially V-shaped cross section on the surface facing toward the hollow portion 43 (See FIG. 5) of the base 42. By forming the guide portion 49 into the V-shape or the substantially V-shape, the guide portion 49 may be projected toward the exhaust port 33 of the tail pipe 38 in the tapered shape.

By forming the guide portion 49 on the supporting beam 48, the lower side of the supporting beam 48 (on the side facing toward the pump chamber 16) is provided with a trough 48*a*.

The valve body 70 is a rubber member formed into the substantially rectangular shape as a whole, and includes a mounting portion 71 capable of abutting against the supporting beam 48 at the substantially center thereof, a ridge 72 at the mounting portion 71. Reinforcing ribs 72*a* are formed in the internal space of the ridge 72 at regular intervals, the ridge 72 being formed so as to be capable of engaging the trough 48*a* of the supporting beam 48. A first and a second flap 74, 76 are formed respectively on both sides (left and right sides) of the mounting portion 71.

The first flap 74 includes a reinforcing rib 75 along the peripheral edges 74*b*–74*d*, and the second flap 76 includes a reinforcing rib 77 along the peripheral edges 76*b*–76*d*.

The supporting bracket 80 includes a supporting portion 81 being capable of abutting against the mounting portion 71 of the valve body 70, and a slanted portion 82 extending from the supporting portion 81 and slanting downward toward the rear.

Figure 5:
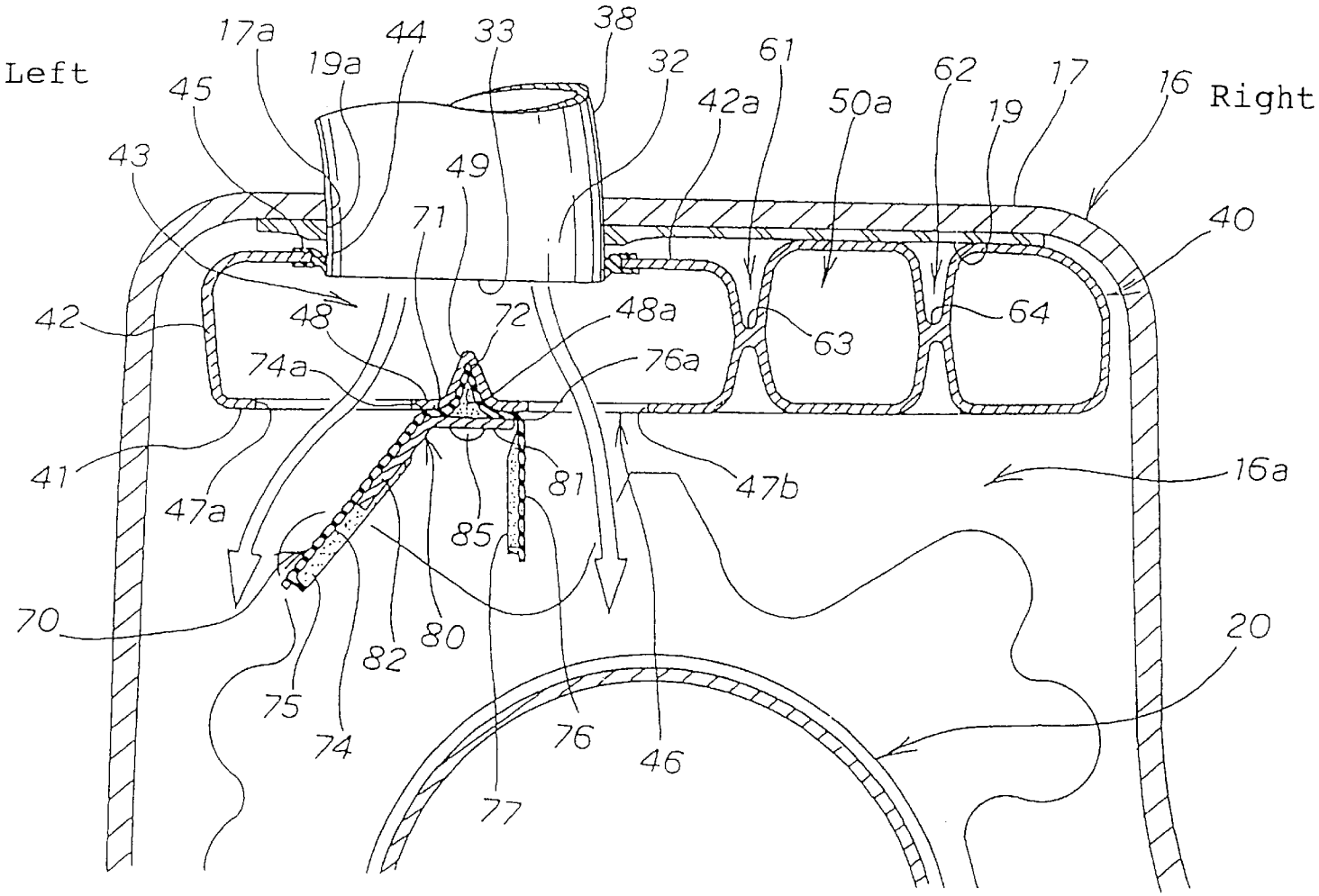
FIG. 5 is a cross sectional view taken along the line 5—5 of FIG. 3.

As shown in FIG. 5, when mounting the valve body 70 on the bottom wall 41 of the resonator 40, the mounting portion 71 of the valve body 70 is positioned on the supporting beam 48 by engaging the ridge 72 of the valve body 70 with the trough 48*a* of the supporting beam 48. The supporting portion 81 of the supporting bracket 80 is abutted against the mounting portion 71, and in this state, the rivets 85, 85 are knocked into the mounting holes 41*a*, 41*a* of bottom wall 41, the mounting holes 78, 78 of the valve body 70, and the mounting holes 83, 83 of the supporting bracket 80 and nuts 86, 86 to clamp the mounting portion 71 of the valve body 70 between the bottom wall 41 and the supporting bracket 80.

The first and the second flaps 74, 76 provided on the valve body 70 are bent at the respective bending portions 74*a*, 76*a* by the weights of the respective flaps 74, 76 and suspended downwardly. The first flap 74 can be maintained in the slanted state (shown in FIG. 5) by supporting the first flap 74 by the slanted portion 82 of the supporting bracket 80.

On the other hand, the second flap 76 is suspended vertically by being bent at the bending portion 76*a* as shown in FIG. 5.

FIG. 5 is a cross sectional view taken along the line 5—5 in FIG. 3, showing a state in which a heat-shield plate 19 is attached on the back side of the top wall 17 of the pump chamber 16. The resonator 40 is provided on the back side of the heat-shield plate 19, and the end 32 of the tail pipe 38 is inserted into the mounting port 17*a* of the top wall 17 of the pump chamber 16 and into the mounting port 19*a* of the heat-shield plate 19. The end 32 of the tail pipe 38 is fitted into the packing 45 so that the tail pipe 38 passes through the peripheral wall (upper wall 42*a* of the base 42) of the resonator 40 to dispose the exhaust port 33 of the tail pipe 38 in the base 42 (hollow portion 43) of the resonator 40. The opening 46 is formed on the peripheral wall (bottom wall) 41 of the resonator 40 and faces upwardly toward the exhaust port 33 and downwardly toward the internal space 16*a* of the pump chamber 16. The guide portion 49 is formed on the surface of the supporting beam 48 on the upstream side (that is, the surface facing toward the exhaust port 33 of the tail pipe 38) so as to project toward the exhaust port 33.

As described above, since an the exhaust port 33 is disposed in the resonator 40 (hollow portion 43 of the base 42) by passing the tail pipe 38 of the exhaust pipe 31 through the peripheral wall of the resonator 40 and the opening 46 is formed on the bottom wall 41 of the resonator 40 facing toward the exhaust port 33, exhaust gas discharged from the exhaust port 33 of the tail pipe 38 can be introduced to the opening 46 (first and second openings 47*a*, 47*b*) of the resonator 40 and discharged into the internal space 16*a* of the pump chamber 16 effectively.

In addition, by forming the guide portion 49 on the surface of the supporting beam 48 on the upstream side so as to project toward the exhaust port 33 of the tail pipe 38, exhaust gas flowing out from the exhaust port 33 can be guided along the guide portion 49 smoothly to the first and the second openings 47*a*, 47*b*.

The figure shows a state in which the opening 46 formed on the bottom wall 41 of the resonator 40 is divided into the first and the second openings 47*a*, 47*b* by the supporting beam 48, and the valve body 70 is mounted on the supporting beam 48.

Since the opening 41 of the resonator 40 is divided into the first and the second openings 47*a*, 47*b* by the supporting beam 48. The first and the second openings 47*a*, 47*b* can be closed by the first and the second flaps 74, 76. Since the opening 41 is divided in two smaller openings 47*a*, 47*b*, the size of first and the second flaps 74, 76 can be made smaller also.

As such, the first and the second openings 47*a*, 47*b* can quickly be opened and closed by the first and the second flaps 74, 76. Therefore, before water enters from the first and the second openings 47*a*, 47*b* into the resonator 40, the first and the second openings 47*a*, 47*b* can be quickly closed by the first and the second flaps 74, 76.

Subsequently, an example in which exhaust gas is discharged from the resonator 40 will be described referring to FIG. 5. The first and the second flaps 74, 76 provided on the valve body 70 are bent downward at the respective bending portions 74*a*, 76*a* by the weights of the respective flaps 74, 76. In this case, since the first flap 74 is supported by the slanted portion 82 of the supporting bracket 80, the first flap 74 can be maintained in the slanted state. On the other hand, the second flap 76 is bent at the bending portion 76*a* by its own weight, and is suspended in a substantially vertical position.

Accordingly, the first and the second openings 47*a*, 47*b* provided on the bottom wall 41 of the resonator 40 may be opened.

Since the opening 46 of the resonator 40 faces upward toward the exhaust port 33 of the tail pipe 38, exhaust gas discharged from the exhaust port 33 of the tail pipe 38 and cooling water discharged together with exhaust gas can be conducted downwardly to the opening 46 of the resonator 40 (that is, the first and the second openings 47*a*, 47*b*) effectively as shown by the arrow.

In addition, since the guide portion 49 of V-shaped or substantially V-shaped cross section is formed on the surface of the supporting beam 48 on the upstream side, exhaust gas flowing out from the exhaust port 33 of the tail pipe 38 and cooling water discharged together with exhaust gas can be guided along the guide portion 49 and conducted smoothly through the first and the second openings 47*a*, 47*b*.

The purpose of supporting the first flap 74 by the slanted portion 82 of the supporting bracket 80 will be described referring to FIG. 7.

Figure 6:
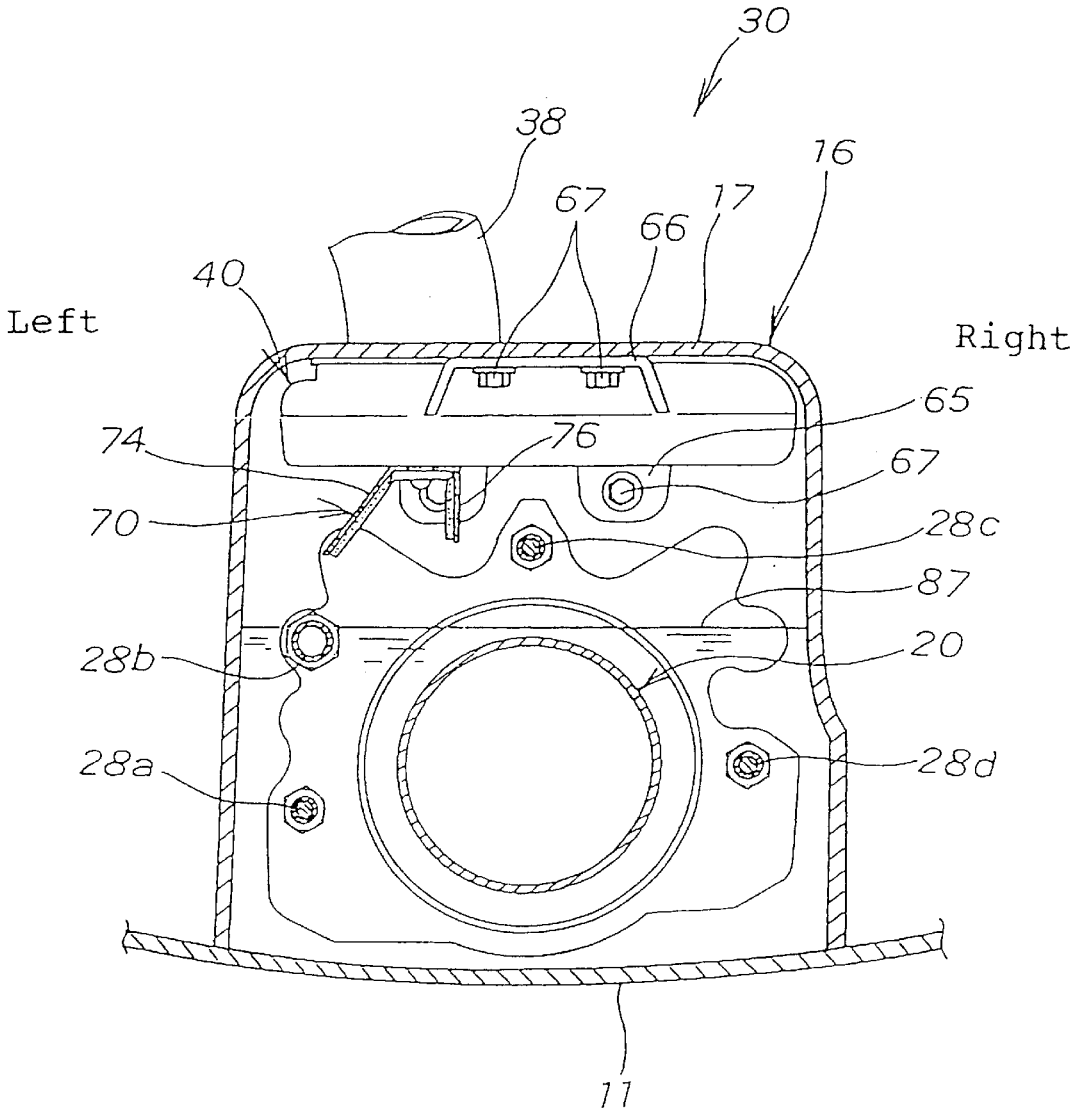
FIG. 6 is a cross sectional view taken along the line 6—6 in FIG. 2.

FIG. 6 is a cross sectional view taken along the line 6—6 in FIG. 2, showing a state in which a jet pump 20 is provided at the center of the pump chamber 16. A resonator 40 is attached on the top wall 17 in the pump chamber 16 while effectively utilizing the dead space. The reverse cable 28*a* and the pipe 28*b* are provided above the jet pump 20, that is, on the left side of the jet pump 20. A cable 28*c* is provided between the jet pump 20 and the resonator 40, and a steering cable 28*d* is provided on the right side of the jet pump 20. Seawater 87 is shown having entered to approximately the level of the upper surface of the jet pump 20.

The reverse cable 28*a* is a cable for operating the reverse bucket 26 (See FIG. 2), and the pipe 28*b* is a pipe for taking cooling water. The cable 28*c* is a cable for trimming, and the steering cable 28*d* is a cable for operating the steering nozzle (See FIG. 2).

An example of seawater is prevented from entering from the opening 46 (the first and the second opening 47*a*, 47*b*) of the resonator 40 will now be described referring to FIG. 7.

Figure 7:
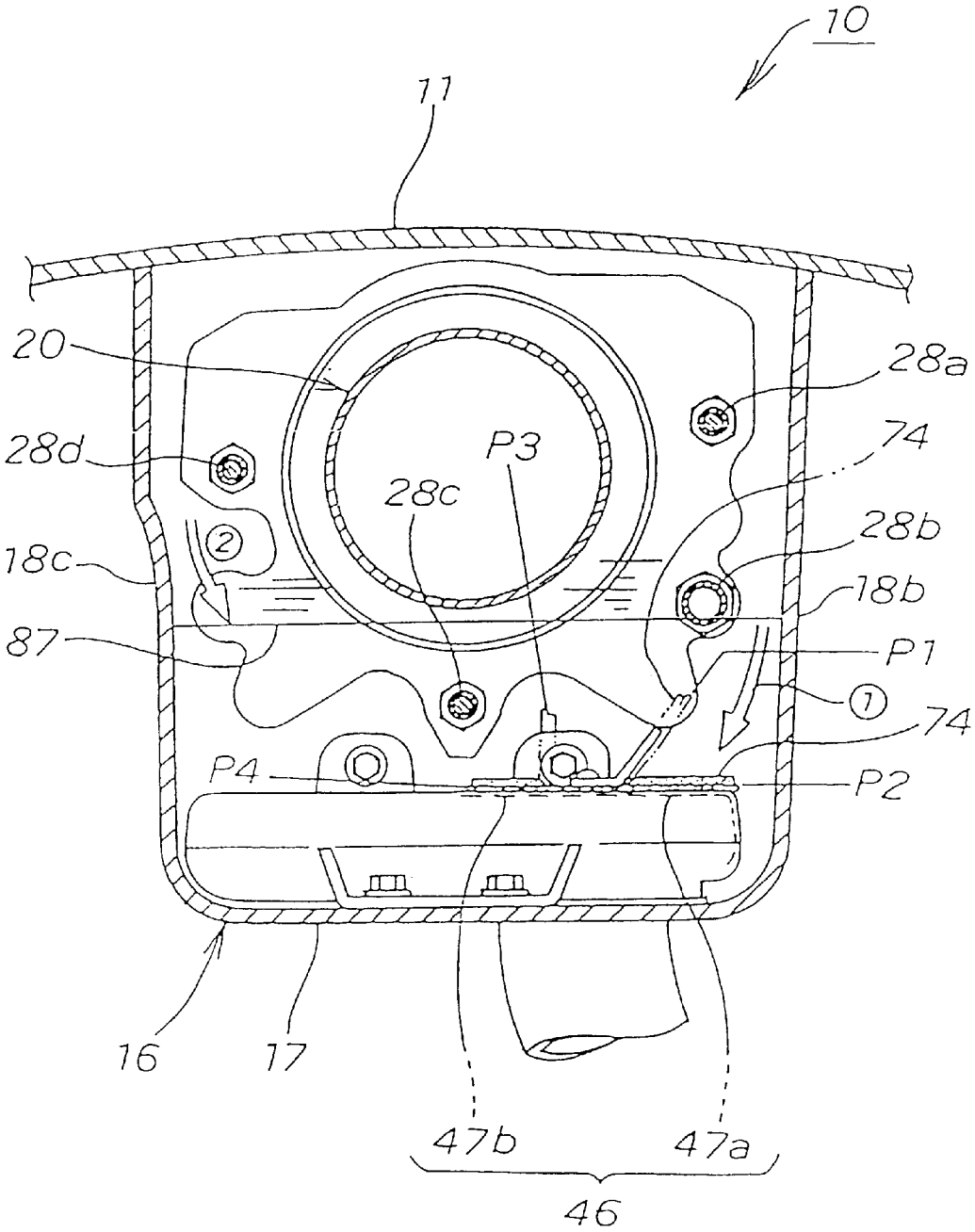
FIG. 7 is an explanatory drawing illustrating how the first embodiment of the present invention prevents water from entering the valve body.

FIG. 7 illustrate a state in which the valve body prevents seawater from entering according to the first embodiment of the present invention.

In the unlikely event that the jet propulsion boat 10 overturned during operation, the first flap 74 moves from the opened position P1 (position represented by a phantom line) to the closed position P2 (position represented by a solid line) by its own weight, and the first flap 74 closes the first opening 47*a* of the resonator 40.

Simultaneously, the second flap 76 moves from the opened position P3 (position represented by a phantom line) to the closed position P4 (position represented by a solid line) by its own weight, and the second flap 76 closes the second opening 47*b* of the resonator 40.

Since the resonator is constructed so that the opening 46 is divided and the first and second openings 47*a*, 47*b* are closed individually by the first and the second flaps 74, 76, the size of the first and the second flaps 74, 76 may be minimized.

By minimizing the first and the second flaps 74, 76, they can be moved from the opened positions (P1, P3) to the closed positions (P2, P4) in a short time. Therefore, the first and the second openings 47*a*, 47*b* can be closed by the flaps 74, 76, respectively, before seawater reaches the first and the second openings 47*a*, 47*b*.

The purpose of supporting the first flap 74 in the slanted state by the slanted portion 82 of the supporting bracket 80 will now be described.

In the unlikely event that the jet propulsion boat 10 is overturned during operation, seawater 87 in the pump chamber 16 falls on the top wall 17 of the pump chamber 16. In this case, since seawater 87 in the vicinity of the left wall 18*b* of the pump chamber 16 falls along the left wall 18*b* smoothly as shown by the arrow ①, it would reach the first opening 47*a* of the resonator 40 relatively quickly. Therefore, it is necessary to quickly close the first opening 47*a* by the first flap 74 of the valve body 70.

Therefore, when the jet propulsion boat 10 is in the normal operation, the first flap 74 is maintained in the slanted state by supporting it by the slanted portion 82 of the supporting bracket 80 as shown in FIG. 5. As a consequence, in the unlikely event that the jet propulsion boat 10 is overturned, the first flap 74 can be moved quickly from the opened position P1 to the closed position P2. Therefore, seawater 87 can be prevented from entering into the resonator 40 by closing the first opening 47*a* with the first flap 74, before seawater 87 falls along the left wall 18*b* of the pump chamber 16 and reaches the first opening 47*a*.

On the other hand, seawater 87 in the vicinity of the right wall 18*c* of the pump chamber 16 falls toward the second opening 47*b* as shown by the arrow ②. Since the second opening 47*b* is located away from the right wall 18*c* and the cable 28*c* is laid in the vicinity of the second opening 47*b*, the cable 28*c* blocks the dropping of seawater 87.

Therefore, a relatively long time is necessary until seawater 87 reaches the second opening 47*b*. Therefore, the second opening 47*b* does not need to be closed as quickly as the first opening 47*a*.

Therefore, as shown in FIG. 5, the second flap 76 is suspended vertically when the jet propulsion boat 10 is in normal operation. As a consequence, the exhaust gas can be discharged effectively through the second opening 47*b*.

When the jet propulsion boat 10 is overturned, since the second opening 47*b* is located away from the right wall 18*c* and seawater is blocked by the cable 28*c*, the second flap 76 is moved from the opened position P3 represented by a phantom line to the closed position P4 represented by a solid line to close the second opening 47*b* with the second flap 76 before seawater 87 reaches the second opening 47*b*. Thus, the entering of seawater 87 through the second opening 47*b* into the resonator 40 is prevented.

Figure 8:
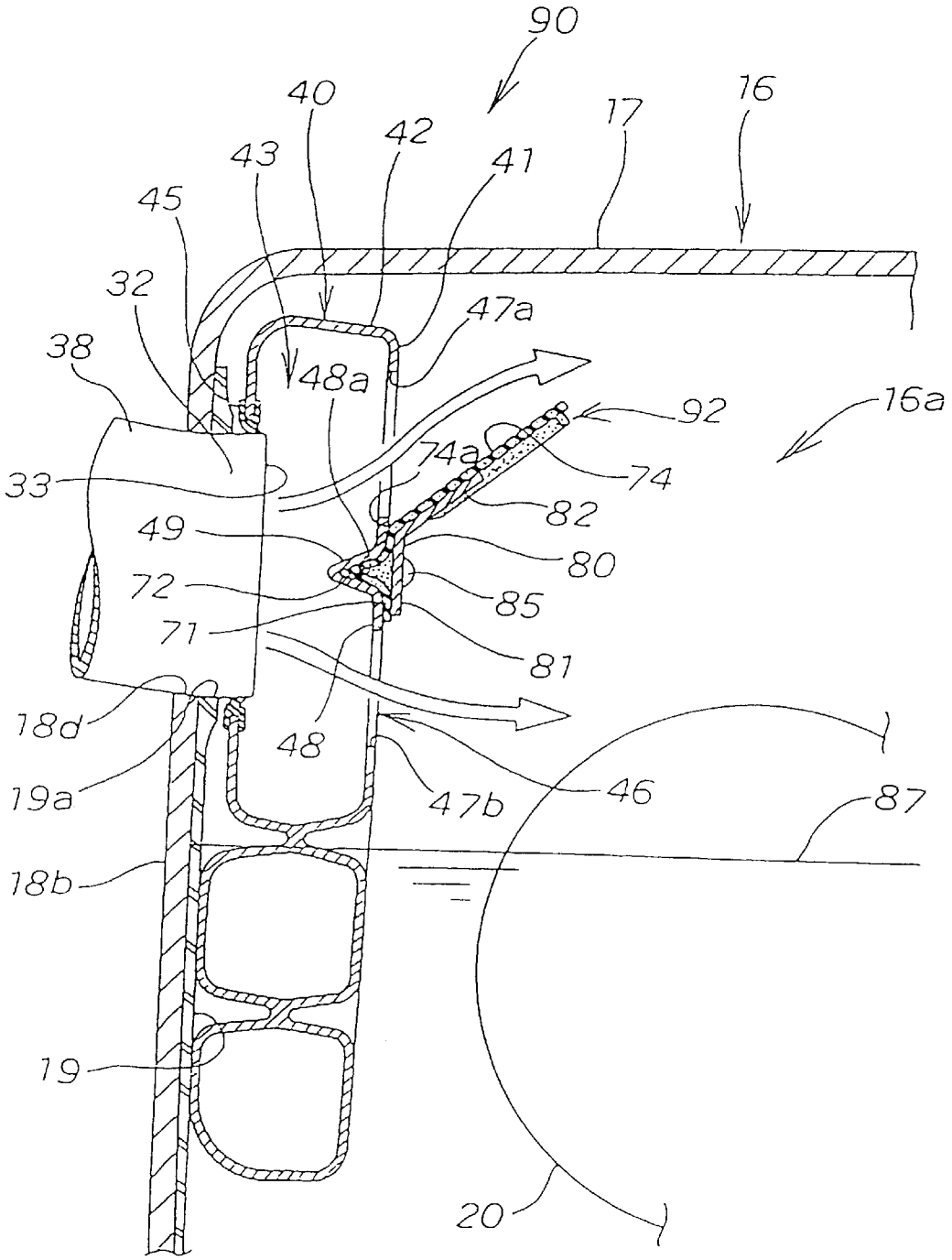
FIG. 8 is a cross sectional view showing a principal portion of the exhaust structure for a jet propulsion boat according to the present invention (second embodiment)
Figure 9:
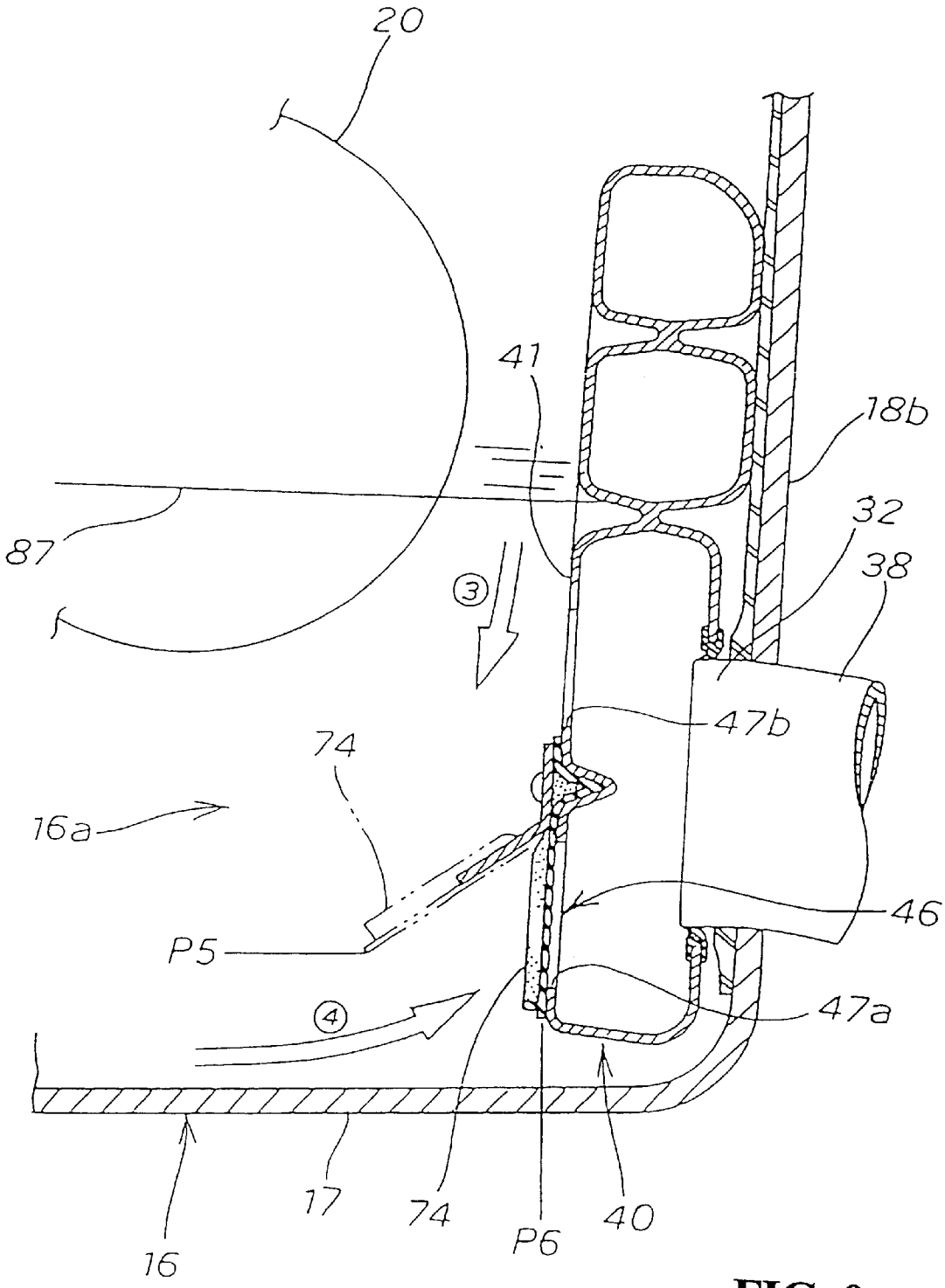
FIG. 9 is an explanatory drawing showing how to the second embodiment of the present invention prevents water from entering the valve body.

Referring now to FIG. 8 and FIG. 9, the second embodiment will be described. In the second embodiment, the same members as in the first embodiment are designated by the same reference numerals, and will not be described again.

FIG. 8 is a cross section of a principal portion of the exhaust structure for a jet propulsion boat according to the present invention (second embodiment).

The exhaust structure 90 for a jet propulsion boat differs from the first embodiment only in that the resonator 40 is mounted along the left wall 18*b* of the pump chamber 16. The other structures are the same as the first embodiment.

In other words, FIG. 8 shows that the exhaust structure 90 for a jet propulsion boat is constructed such that the heat-shield plate 19 is mounted on the backside of the left wall 18*b* of the pump chamber 16. The resonator 40 is provided on the backside of the heat-shield plate 19. The end 32 of the tail pipe 38 is inserted into the mounting port 18*d* of the left wall 18*b* of the pump chamber 16 and the mounting port 19*a* of the heat-shield plate 19 and the end 32 of the tail pipe 38 is fitted into the packing 45 to face the exhaust port 33 of the tail pipe 38 toward the hollow portion 43 of the base 42. The opening 46 of the bottom wall 41 of the resonator 40 is faced toward the inner space 16*a* of the pump chamber 16.

The opening 46 is divided into the first opening 47*a* and the second opening 47*b* by the supporting beam 48, as in the first embodiment.

Simultaneously, FIG. 8 shows a state in which the guide portion 49 is provided on the supporting beam 48 to face toward the exhaust port 33 of the tail pipe 38 and the ridge 72 of the valve body 92 is engaged with the trough 48*a* on the supporting beam 48 to position the mounting portion 71 of the valve body 92 with respect to the supporting beam 48. The supporting portion 81 of the bracket 80 is abutted against the mounting portion 71, and in this state, the rivets 85, 85 (only the one on the far side is shown in the figure) is knocked in, as in the first embodiment, to clamp the mounting portion 71 of the valve body 92 between the bottom wall 41 and the supporting bracket 80.

The structure of the valve body 92 is the same as the valve body 70 in the first embodiment, except that the second flap 76 is removed from the valve body 70.

The first flap 74 provided on the valve body 92 is bent downward at the bending portion 74*a* by being applied with its own weight. In this case, the first flap 74 is supported in the slanted state by supporting the first flap 74 by the slanted portion 82 of the supporting bracket 80.

Consequently, the first opening 47*a* formed on the bottom wall 41 of the resonator 40 can be opened. On the other hand, since the second opening 47*b* is not provided with a flap, it is always in the opened state.

Therefore, exhaust gas discharged from the exhaust port 33 of the tail pipe 38 can be guided by the guide portion and conducted to the first and the second openings 47*a*, 47*b* as shown by the arrow.

Referring now to FIG. 9, an example of preventing entering of seawater from the opening 46 of the resonator 40 will be described.

FIG. 9 is an explanatory drawing showing a state in which entering of seawater is prevented by a valve body according to the second embodiment of the present invention.

In the unlikely event that the jet propulsion boat is overturned during travel, seawater 87 in the pump chamber 16 falls toward the top wall 17 of the pump chamber 16. In this case, since seawater 87 in the vicinity of the left wall 18*b* of the pump chamber 16 falls along the bottom wall 41 of the resonator 40 as shown by the arrow ③, it passes over the second opening 47*b* of the resonator 40. Therefore, seawater 87 does not enter from the second opening 47*b*, even though a flap is not provided at the second opening 47*b*.

The second opening 47*b* is formed at the position that comes above the sea level when the boat is overturned.

On the other hand, seawater 87 in the center of the pump chamber 16 falls on the top wall 17 and flows toward the first opening 47*a* as shown by the arrow ④. Therefore, the first flap 74 is provided at the first opening 47*a* so that the first flap 74 moves from the opened position P5 shown by a phantom line to the closed position P6 shown by a solid line, and closes the first opening 47*a* by the first flap 74 preventing seawater 87 from entering into the resonator 40.

The exhaust structure 90 for a jet propulsion boat according to the second embodiment can provide the same effects as the first embodiment.

In other words, according to the second embodiment, the dead space left in the vicinity of the wall surface can be effectively utilized by placing the resonator 40 along the left wall 17 of the pump chamber 16 (See FIG. 8). In addition, it is not necessary to secure the storage space for storing the resonator 40 inside the hull 11, because the resonator is mounted in the pump chamber 17 which is outside the hull 11.

In this way, by placing the resonator 40 along the top wall 17 of the pump chamber 16, the resonator 40 can be mounted with less trouble.

According to the second embodiment, since the opening 46 of the resonator 40 is faced toward the exhaust port 33 of the tail pipe 38, exhaust gas discharged from the exhaust port 33 of the tail pipe 38 can be conducted effectively to the opening 46 (that is, the first and the second openings 47*a*, 47*b*) of the resonator 40.

Further, according to the second embodiment, since the opening 46 is divided into the first and the second openings 47*a*, 47*b*, the size of first flap 74 covering the first opening 47*a* can be minimized.

Since the first flap 74 can be moved from the opened position to the closed position in a short time, the first opening 47*a* can be closed by the first flap 74 before water enters the first opening 47*a*.

Furthermore, according to the second embodiment, by providing a guide portion 49 of V-shaped or substantially V-shaped cross section on the surface of the supporting beam 48 on the upstream side, exhaust gas discharged from the exhaust port 33 of the tail pipe 38 and cooling water discharged with the exhaust gas can be guided along the guide portion 49 and conducted smoothly out through the first and the second openings 47*a*, 47*b*.

Though the resonator 40 is provided on the top wall 17 of the pump chamber 16 in the first embodiment and the resonator 40 is provided on the left wall 17*b* of the pump chamber 16 in the second embodiment according to the description above, it is not limited thereto. It is possible to provide the resonator on other wall surfaces of the pump chamber 16. It is also possible to provide the resonator 40 on the portion other than the wall surface in the pump chamber 16.

Further, though the opening 46 on the bottom wall 41 of the resonator is rectangular in the embodiments described above, it is not limited thereto. It is also possible to form the opening 46 in other configurations such as circle.

In addition, while the example in which the resonator 40 is formed in the meandering state was described in the aforementioned embodiments, it is not limited thereto. It is possible to form the resonator linearly, and dispose it in the dead space in the pump chamber 16.

Though the example in which the first flap 74 is supported by the slanted portion 82 of the supporting bracket 80 in the slanted state during normal operating conditions was described in the first and the second embodiments, the slanted state of the first flap 74 can be selected arbitrary. In addition, in the first embodiment, it is possible to eliminate the slanted portion 82 from the supporting bracket 80 and suspend the first flap 74 in the vertical direction.

Further, though the example in which the guide portion 49 is formed integrally with the supporting beam 48 was described in the aforementioned embodiments, it is not limited thereto. It is also possible to mount the separate guide portion 49 on the supporting beam 48.

With the construction described above, the present invention provides the following effects.

A sound-deadening resonator is disposed while effectively utilizing the dead space in the pump chamber. Therefore, it is not necessary to take a long time considering how best to secure the storage space for the resonator in the vessel.

Therefore, the resonator can be mounted easily, and thus exhaust noise of the jet propulsion boat can be alleviated without trouble.

The exhaust port is disposed in the resonator, and the opening is formed on the peripheral wall of the resonator at the position facing toward the exhaust port. Therefore, exhaust gas discharged from the exhaust port and cooling water discharged with exhaust gas can be conducted effectively discharged out through the opening on the bottom of the resonator.

The opening of the resonator is divided into the first and the second openings, and the divided openings are individually closed by separate flaps. By providing separate flaps, the size of each flap can be minimized. Thus, the first and the second openings can be quickly closed by the respective flaps.

Therefore, the first and the second openings can be closed by the flaps before water enters into the resonator.

The guide portion of V-shaped or substantially V-shaped cross section is formed on the supporting beam so as to project toward the exhaust port. Thus exhaust gas and cooling water discharged with exhaust gas can be guided along the guide portion and discharged effectively out through the first and the second openings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust structure for a jet propulsion boat in which a tunnel-shaped pump chamber is provided at a rear portion of a hull of the boat, a jet propulsion machine is provided in the pump chamber, an engine is connected to the jet propulsion machine for driving the boat, and an exhaust port of an exhaust pipe extending from the engine faces toward the pump chamber, wherein a resonator for sound-deadening is disposed in the pump chamber and the exhaust pipe is brought into communication with the resonator.

2. The exhaust structure for a jet propulsion boat according to claim 1, wherein the exhaust port is disposed in the resonator by passing the exhaust pipe through a peripheral wall of the resonator and an opening is provided on a bottom wall of the resonator at the location facing upwardly toward the exhaust pipe and downwardly toward the pump chamber.

3. The exhaust structure for a jet propulsion boat according to claim 1, wherein the resonator includes a base portion and a resonator body integrally formed with the base so that the resonator is formed as a substantially flat plate.

4. The exhaust structure for a jet propulsion boat according to claim 1, wherein the pump chamber has an internal space extending in a fore-and-aft direction and the resonator is attached to a top wall of the pump chamber.

5. The exhaust structure for a jet propulsion boat according to claim 4, wherein the base portion of the resonator is offset to one side of the top wall of the pump chamber.

6. The exhaust structure for a jet propulsion boat according to claim 4, wherein an opening on a wall of the resonator facing toward the pump chamber is divided into a first and a second opening by a supporting beam, and a valve body is attached on the supporting beam so that the first and the second opening can be opened and closed by a pair of flaps provided on the valve body.

7. The exhaust structure for a jet propulsion boat according to claim 6, wherein the supporting beam is provided with a guide portion having cross section that is substantially V-shaped and projecting toward the exhaust port.

8. The exhaust structure for a jet propulsion boat according to claim 6, wherein one flap is maintained in a slanted position when open, and the other flap is maintained in a vertical position when open.

9. The exhaust structure for a jet propulsion boat according to claim 1, wherein the pump chamber has an internal space extending in a fore-and-aft direction and the resonator is attached to a left wall of the pump chamber.

10. The exhaust structure for a jet propulsion boat according to claim 9, wherein the opening is divided into a first and a second opening by a supporting beam, and a valve body is attached on the supporting beam, wherein first opening can be opened and closed by a flaps provided on the valve body, and the second opening is always open.

11. An exhaust structure for a jet propulsion boat, comprising:

a tunnel-shaped pump chamber extending in a fore-and-aft direction provided outside a rear portion of a hull of the boat;

a jet propulsion machine provided in the pump chamber;

an engine connected to the jet propulsion machine for driving the boat; and an exhaust port of an exhaust pipe extending from the engine faces toward the pump chamber, wherein a resonator for sound-deadening is disposed in the pump chamber and the exhaust pipe is brought into communication with the resonator.

12. The exhaust structure for a jet propulsion boat according to claim 11, wherein the exhaust port is disposed in the resonator by passing the exhaust pipe through a peripheral wall of the resonator and an opening is provided on a bottom wall of the resonator at the location facing upwardly toward the exhaust pipe and downwardly toward the pump chamber.

13. The exhaust structure for a jet propulsion boat according to claim 11, wherein the resonator includes a base portion and a resonator body integrally formed with the base so that the resonator is formed as a substantially flat plate.

14. The exhaust structure for a jet propulsion boat according to claim 11, wherein the pump chamber has an internal space and the resonator is attached to a top wall of the pump chamber so as to be disposed in the internal space of the pump chamber.

15. The exhaust structure for a jet propulsion boat according to claim 14, wherein the base portion of the resonator is offset to one side of the top wall of the pump chamber.

16. The exhaust structure for a jet propulsion boat according to claim 14, wherein an opening on a wall of the resonator facing toward the pump chamber is divided into a first and a second opening by a supporting beam, and a valve body is attached on the supporting beam so that the first and the second opening can be opened and closed by a pair of flaps provided on the valve body.

17. The exhaust structure for a jet propulsion boat according to claim 16, wherein the supporting beam is provided with a guide portion having cross section that is substantially V-shaped and projecting toward the exhaust port.

18. The exhaust structure for a jet propulsion boat according to claim 16, wherein one flap is maintained in a slanted position when open, and the other flap is maintained in a vertical position when open.

19. The exhaust structure for a jet propulsion boat according to claim 11, wherein the pump chamber has an internal space extending in a fore-and-aft direction and the resonator is attached to a left wall of the pump chamber.

20. The exhaust structure for a jet propulsion boat according to claim 19, wherein the opening is divided into a first and a second opening by a supporting beam, and a valve body is attached on the supporting beam, wherein first opening can be opened and closed by a flaps provided on the valve body, and the second opening is always open.

* * * * *